United States Patent [19]

Yamazaki et al.

[11] Patent Number: 4,939,431

[45] Date of Patent: Jul. 3, 1990

[54] CONTROL SYSTEM FOR SYNCHRONOUS ROTATION OF CUTTER HEADS, FOR USE IN SHIELD MACHINE

[75] Inventors: Hidetsugu Yamazaki, Ibaraki; Ryuzaburo Otsuka, Aichi; Takashi Moro, Ibaraki; Toshihumi Yuzawa, Aichi; Seiji Tadano, Kanagawa; Kiyoshi Tsuchiya, Ibaraki, all of Japan

[73] Assignees: Ishikawajima-Harima Kukogyo K.K.; Hitachi Construction Machinery Co., Ltd.; Ohbayashi Corp.; Taisei Corp.; Daiho Construction Co., Ltd., all of Japan

[21] Appl. No.: 383,533

[22] Filed: Jul. 21, 1989

[30] Foreign Application Priority Data

Nov. 29, 1988 [JP] Japan ..... 63-299664

[51] Int. Cl.[5] ..... H02P 7/74

[52] U.S. Cl. ..... 318/41; 318/45; 318/50; 318/68

[58] Field of Search ..... 318/41, 45, 48, 50, 318/53, 59, 66, 68, 69, 70, 71, 77, 78, 85

[56] References Cited

U.S. PATENT DOCUMENTS

| | | | |
|---|---|---|---|
| 2,320,850 | 6/1943 | Cook | 318/77 |
| 3,132,293 | 5/1964 | Marrs | 318/97 X |
| 3,447,050 | 5/1969 | Geis | 318/78 |
| 4,447,788 | 5/1984 | Mundt et al. | 318/85 X |
| 4,491,767 | 1/1985 | Eastcott et al. | 318/85 |
| 4,591,772 | 5/1986 | Hollow | 318/48 X |

*Primary Examiner*—Bentsu Ro

*Attorney, Agent, or Firm*—Wenderoth, Lind & Ponack

[57] ABSTRACT

In a control system for synchronous rotation of the cutter heads in a multi-cutter shield machine, the rotation cutter heads are so disposed in generally the same plane such that the distance between the centers of the adjoining cutter heads is larger than the radius, and smaller than the diameter, of the cutter heads. The rotating cutter heads are driven independently of each other by electric drive systems, respectively. Each of the electric drive systems consists of plural motors with a reduction gear, coupled to the respective rotating cutter heads by means of a pinion and gear. The motor rotation is so controlled and the cutter heads are so synchronously rotated, that the angle of deviation between the cutter heads is within such an allowable range that the cutter heads will not interfere with each other even if there is any imbalance in excavating and rotating resistances between the cutter heads.

3 Claims, 13 Drawing Sheets

CONTROL SYSTEM FOR SYNCHRONOUS ROTATION OF CUTTER HEADS, FOR USE IN SHIELD MACHINE

BACKGROUND OF THE INVENTION (a) Field of the Invention:

The present invention relates to a shield machine having a plurality of rotating cutter heads so disposed in generally same planes that the distance between the centers of adjoining rotating cutter heads is larger than the radius, and smaller than the diameter, of the rotating cutter heads, and more particularly to a control system for the synchronous rotation of the cutter heads, wherein the cutter heads are so driven independently of each other by electric drive systems, respectively, each comprising plural motors with a reduction gear, as to rotate synchronously with each other and with such a difference in phase between the cutter heads as will not cause any interference between them during rotation.

(b) Description of the Prior Art:

As a shield machine suitable for use in building a railway tunnel, subway tunnel or vehicular tunnel having more than one lane, there has been proposed a multi-cutter shield machine having, a plurality of rotating cutter heads so disposed in generally the same plane such that the distance between the centers of adjoining rotating cutter heads is larger than the radius, and smaller than the diameter, of the rotating cutter heads, and which bore a tunnel of which the section takes the shape of a combination of two circles partially superposed, that is, a so-called cocoon or the like. Such shield machines are disclosed in, for example, Japanese Unexamined Patent Publications Sho 57-197395 and Sho 62-99597.

With such multi-cutter shield machines, in case, for example, two rotating cutter heads are disposed in substantially the same plane, the tunnel face areas of excavation by the respective rotating cutter heads can be made nearly equal to each other. Thus, it is easy to well balance the excavating resistances to the respective rotating cutter heads and so a one-side force which would otherwise adversely affect the posture of the entire shield machine will hardly occur. On the other hand, it is necessary to rotate the cutter heads synchronously with each other and with such a phase difference between the cutter heads that no interference will take place between them during rotation.

The typical conventional control systems or means for synchronous rotation of the adjoining cutter heads include the following:

(1) A control system in which a pinion fixed to the output shaft of the cutter drive motor is in mesh with a large gear fixed concentrically to each rotating cutter head and the large gears engage with each other to provide a mechanical synchronous rotation of the cutter heads.

(2) A control system in which the large gears are not in mesh with each other but the cutter heads are rotated synchronously with each other while the respective cutter heads are driven independently of each other, by electrically controlling the cutter drive motors.

In the control system (1), however, when one of the rotating cutter heads is suddenly stopped when an abnormally large load is applied, cutter drive torque will act on one tooth of the large gear. For such a sufficient strength of each tooth for withstanding the load, the tooth dimensions such as width, thickness and the like must be sufficiently large, which will make it difficult in practice to manufacture such gears.

In the control system (2), all the load torques to the rotating cutter heads are not identical to each other but the load to the cutter heads varies due to differences in soil during excavation, so that a deviation in angle (difference in angle of rotation) is likely to occur between the adjoining rotating cutter heads due to a slight difference in speed of rotation between the cutter heads. This control system needs a correction against such angle of deviation. Furthermore, in case the rotating cutter heads are driven independently of each other by electric drive systems, respectively, each comprising plural motors with a reduction gear in order to disperse the drive torque, it is difficult to have the plural motors driving the rotating cutter heads share uniformly the torque even if the cutter head drive systems are controlled for synchronous rotation of the cutter heads. If the excavating resistances and rotating resistances to the cutter heads are out of balance between the cutter heads, it is not possible to limit the angle of deviation between the cutter heads to within the allowable range, which leads to an interference between the cutter heads.

SUMMARY OF THE INVENTION

The present invention has an object to provide a multicutter shield machine having a plurality of rotating cutter heads so disposed in substantially the same plane such that the distance between the centers of the adjoining rotating cutter heads is larger than the radius, and smaller than the diameter, of the rotating cutter heads, wherein the rotating cutter heads are so driven independently of each other by electric drive systems, respectively, each comprising plural motors with a reduction gear as to rotate synchronously with each other with the difference in angle of rotation between two adjoining rotating cutter heads being limited to within an allowable range in which no interference occurs between the cutter heads even if the excavating and rotating resistances to the respective cutter heads are out of balance between the cutter heads.

To attain the above object, the present invention provides a multi-cutter shield machine in which one of the adjoining rotating cutter heads is taken as a first rotating cutter head while the other is taken as a second rotating cutter head, a motor representative, that is, a master motor, of a first motor group driving the first rotating cutter head is so speed-controlled by a first speed control means that the deviation between a speed command given from one speed setting means and a speed detected-value signal from a first speed detecting means which detects the rotating speed of the motor becomes zero. Also, a master motor of a second motor group driving the second rotating cutter head is so speed-controlled by a second speed control means that there is no deviation between a signal derived from the addition to a speed command given from one speed setting means of a deviation angle detected-value signal from a deviation angle detecting means which detects an angle of deviation between the first and second rotating cutter heads and a speed detected-value signal from a second speed detecting means which detects the rotating speed of the motors. Owing to the actions of these first and second speed control means, the first rotating cutter head provides for the reference of synchronous rotation while the second rotating cutter head rotates following up with the first rotating cutter head.

On the other hand, the other motors, that is, subordinate motors, in the respective motor groups are so torque-controlled by respective torque control means with torque commands given by a first and second torque setting means and which are based on a current detected-value of the master motor of the aforementioned motor group that the generated torques of the subordinate motors become a generated torque of the master motor of the motor group; consequently, any imbalance in torque between the master motor of each motor group and the subordinate motors in the motor group will not disturb the synchronization between the master motors of the motor groups and the angle of deviation between the cutter heads is limited to within such an allowable range as will not cause any interference between the cutter heads, whereby the cutter heads can be rotated synchronously with each other.

BRIEF DESCRIPTION OF THE DRAWINGS

FIGS. 1 to 9 show one embodiment of the control system for synchronous rotation of the cutter heads in a shield machine according to the present invention, of which:

FIG. 1 is a system configuration diagram of the control system for synchronous rotation of the cutter heads;

FIG. 2 is an axial sectional view of two-cutter shield machine to which the present invention is applied;

FIG. 3 is a view from the arrow II in FIG. 2;

FIG. 4 is a sectional view showing the geometrical relation of the motors in the two-cutter shield machine;

FIG. 5 is an explanatory drawing of the permissible angle of deviation between the rotating cutter heads;

FIGS. 6 to 9 are detailed circuit diagrams, respectively, of each control unit in FIG. 1;

FIGS. 10 to 14 show another embodiment of the control system for synchronous rotation of the cutter heads according to the present invention, of which:

FIG. 10 is a system configuration diagram of the control system for synchronous rotation of the cutter heads;

FIGS. 11 to 13 are detailed circuit diagrams of the control units in FIG. 10; and FIG. 14 is an explanatory drawing functionally showing the torque control.

DETAILED DESCRIPTION OF THE PREFERRED EMBODIMENTS

The embodiments of the control system for synchronous rotation of the cutter heads in a shield machine according to the present invention will be described in detail herebelow with reference to the drawings.

Figure 1:
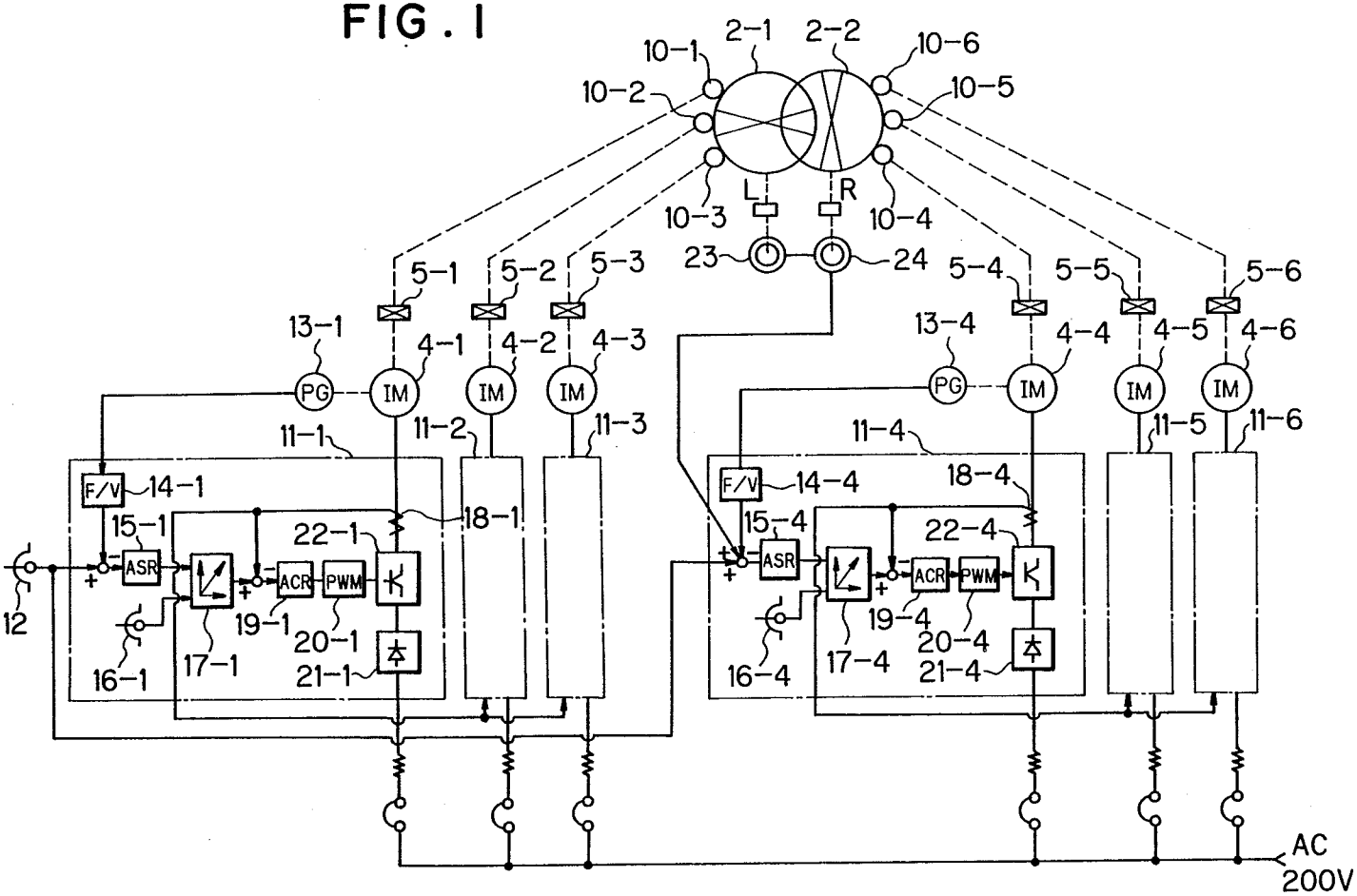
Figure 2:
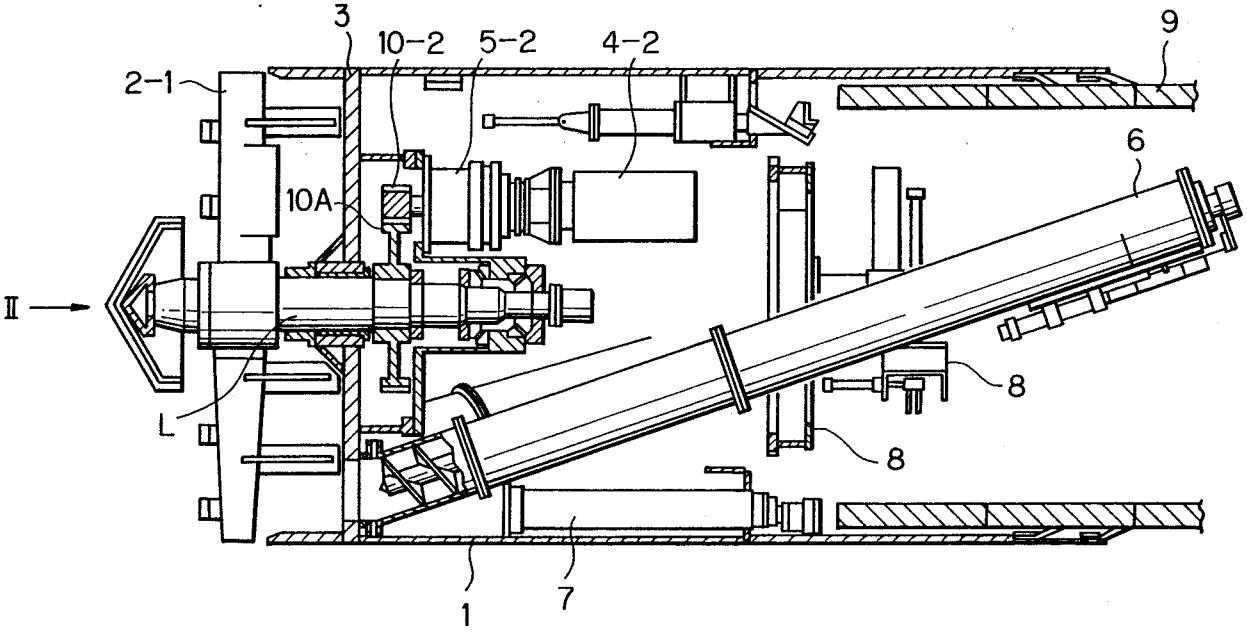
Figure 3:
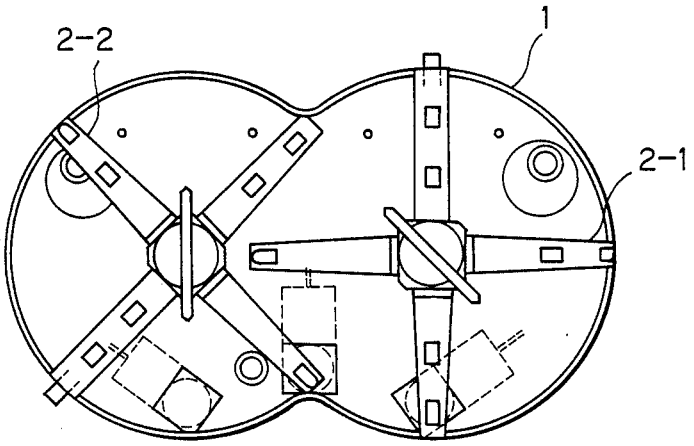
Figure 4:
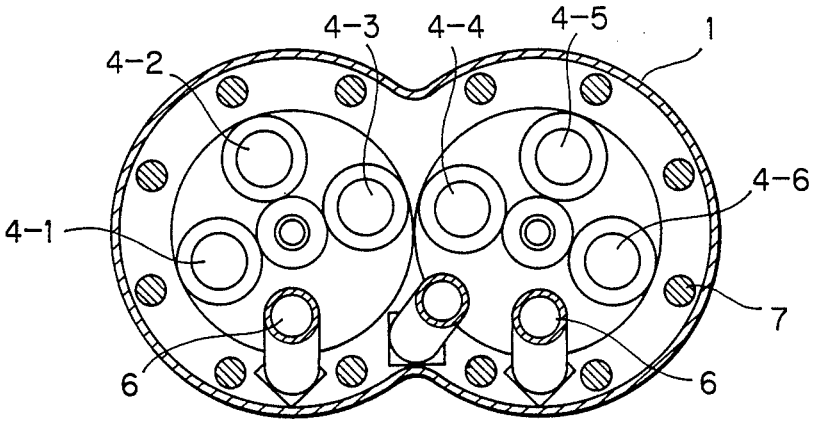

FIGS. 1 to 9 show the first embodiment of the present invention. FIG. 2 shows the whole structure of a two-cutter shield machine according to the present invention. As shown in FIG. 3, the shield body 1 has a cross-section like a cocoon profile such as resulted from a partial superposition of two circles, and has provided at the front thereof two spoke-type rotating cutter heads 2-1 and 2-2 having the centers of rotation at the centers of the above-mentioned respective circles and which are disposed in nearly same planes, with the distance between the centers of the cutter heads selected to be larger than the excavating radius, and smaller than the diameter, of the rotating cutter heads. According to this embodiment, each of the rotating cutter heads 2-1 and 2-2 has four spokes and the phase difference between the cutter heads is selected to be 45 deg.

The rotating cutter heads 2-1 and 2-2 are driven independently of each other; the cutter head 2-1 is driven by an electric drive system comprising motors 4-1, 4-2 and 4-3 disposed inside a bulkhead 3, namely, inside the body 1 and which are provided with reduction gears 5-1, 5-2 and 5-3, respectively, while the cutter head 2-2 is driven by an electric drive system consisting of motors 4-4, 4-5 and 4-6 provided with reduction gears 5-4, 5-5 and 5-6, respectively. The rotation of the motors 4-1, 4-2 and 4-3 is reduced by the reduction gears 5-1, 5-2 and 5-3, respectively, and transmitted to the center shaft (L shaft) of the rotating cutter head 2-1 via the pinions mounted on the output shafts, respectively, of the reduction gears and gears in mesh with the respective pinions. Similarly, the rotation of the motors 4-4, 4-5 and 4-6 is slowed down by the reduction gears 5-4, 5-5 and 5-6, respectively, and transmitted to the center shaft (R shaft) of the rotating cutter head 2-2 via the pinions mounted on the output shafts, respectively, of the reduction gears and gears in mesh with the respective pinions. The sets of the above-mentioned pinions and gears are typically indicated with reference numerals 10-2 and 10-a. In addition, there are provided behind the bulkhead 3 and inside the body 1 a soil carry-out screw conveyor 6, shield jack 7, erector 8 and so forth. Thus, a tunnel boring is done with the tunnel face excavation by the rotating cutter heads 2-1 and 2-2 and the thrust of the shield jack 7 using, as reaction receiver, segments 9 assembled by the erector 8.

Figure 5:
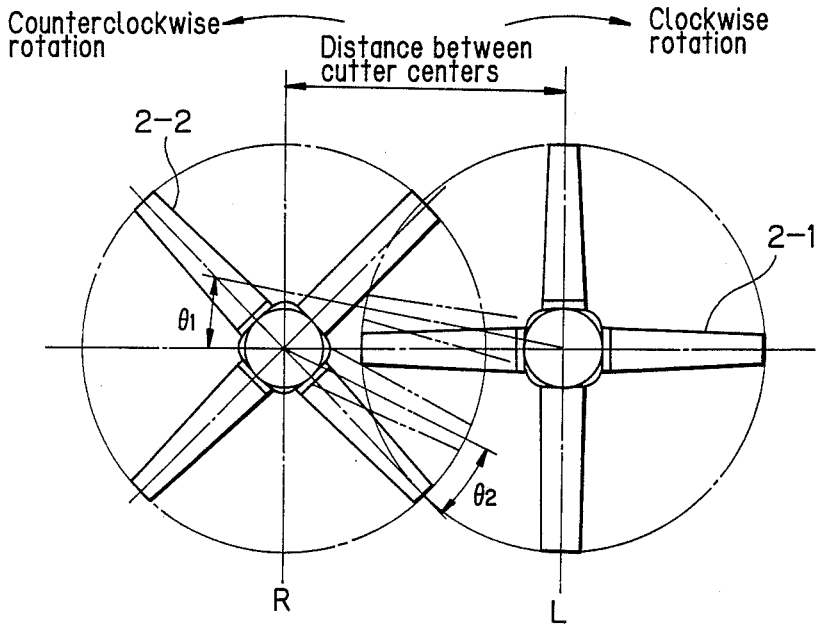

FIG. 5 shows the counterrotation of the rotating cutter heads 2-1 and 2-2. In this drawing, it is assumed that the rotating cutter head 2-1 rotates clockwise while the rotating cutter head 2-2 rotates counterclockwise. There are set angles of deviation $\theta_1$ and $\theta_2$ from positions of rotation (indicated with solid line) at which there is a phase difference (45 deg.) between the rotating cutter heads 2-1 and 2-2 to the limit positions (indicated with two dot line) where the cutter heads do not interfere with each other. The allowable angle of deviation ($\pm\theta$) between the cutter heads is selected taking account of some tolerance for minimum values of the angles of deviation $\theta_1$ and $\theta_2$ obtained at positions of rotation during one full rotation of each cutter head. Therefore, by rotating the two cutter heads synchronously with each other in such a manner that the angle of deviation from a predetermined phase difference can be kept within the allowable angle of deviation, the cutter heads will not interfere with each other.

FIG. 1 is a system configuration diagram of one embodiment of the control system for synchronous rotation of the cutter heads according to the present invention. The system will be outlined with reference to this Figure. As shown, the motors 4-1, 4-2 and 4-3 in a group are coupled to the rotating cutter head 2-1 by means of the reduction gears 5-1, 5-2 and 5-3 and the pinions 10-1, 10-2 and 10-3, respectively, the motors 4-4, 4-5 and 4-6 in a group are coupled to the rotating cutter head 2-2 by means of the reduction gears 5-4, 5-5 and 5-6 and the pinions 10-4, 10-5 and 10-6, respectively. In the following description, the rotating cutter head 2-1 is assumed to be the first rotating cutter head providing for the reference of synchronous rotation, while the rotating cutter head 2-2 is to be the second rotating cutter head which rotates following up with the cutter head 2-1. Also, one (4-1) of the first motor group driving the rotating cutter head 2-1 is taken as the master motor of the group while the remaining two motors 4-2 and 4-3 of the same group are as ones subordinate to the master motor of the group. Similarly, one (4-4) of the second motor group driving the rotating cutter head 2-2 is taken as the master motor of the group while the remaining two motors 4-5 and 4-6 of the same group are as ones subordinate to the master motor of the group.

According to this embodiment, squirrel-cage induction motors (IM) are used as cutter head driving motors and all the motors are of a same number of poles and same ratings.

The control system according to the present invention comprises a controller consisting of control units 11-1 and 11-4 for speed-control of the motors 4-1 and 4-4 and control units 11-2, 11-3, 11-5 and 11-6 for torque-control of the motors 4-2, 4-3, 4-5 and 4-6. A vector control excellent in performance of dynamic speed control, employed for speed-control of the motors 4-1 and 4-4, will be described below.

The control unit 11-1 converts, by means of a frequency-voltage converter (F/V) 14-1, an AC output of a pilot generator (PG) 13-1 connected directly to the motor 4-1 into a DC voltage proportional to a speed. A deviation between this DC voltage signal (speed detected value) and an L-shaft speed command (speed set value) from a speed setter 12 is supplied to an automatic speed regulator (ASR) 15-1. The output of the automatic speed regulator 15-1 is taken as torque current set-value, and this signal and a magnetizing current set-value from a magnetic flux setter 16-1 are vector-composed by a vector calculator 17-1 to provide an equivalent two-phase current set-value which will be subject to a two/three phase conversion to provide a three-phase primary current set-value. A deviation between this primary current set-value and a primary current detected-value provided from a current detector 18-1 is supplied to an automatic current regulator (ACR) 19-1, of which the output is modulated by a pulse width modulator (PWM) 20-1 and applied as pulse width control signal to an inverter 22-2. A DC output from a rectifier 21-1 is converted into an AC power variable in frequency and voltage which is supplied to the motor 4-1, thereby controlling the speed of the latter.

The control unit 11-4 is composed of similar elements, provided that it is supplied with an R-shaft speed command (speed set-value) from the speed setter 12 and the output signal (speed detected-value) from a pilot generator (PG) 13-4 connected directly to the motor 4-4, and in addition, with a detected-value signal of deviation angle (deviation angle detected-value) between the rotating cutter heads 2-1 and 2-2, provided from a sync generator 23 coupled to the L-shaft and a sync control transformer 24 connected to the R-shaft. The motor 4-4 is so speed-controlled that both the difference between the speed set- and detected-values and the deviation angle detected-value are zero.

Next, the above-mentioned deviation angle detection and speed correction with the deviation angle detected-value will be supplementarily described. As well known, each of the sync generator 23 and sync control transformer 18 consists of a pair of a stator having a three-phase winding and a rotor having a single-phase winding. When the rotor of the sync generator 17 is excited with an AC voltage while the stator windings of the sync generator 17 connected to one (L-shaft) of the two shafts on which an angle of deviation is to be detected and the sync control transformer 18 connected to the other shaft (R-shaft), respectively, are interconnected to each other, a value corresponding to the magnitude of the angle of deviation between the two shafts and a voltage (deviation angle detected-value signal) of a polarity corresponding to whether the angle of deviation is positive or negative. In a signal conversion circuit (not shown), this output signal is detected, has the carrier wave of AC input frequency removed therefrom, and then it is subject to such an offset adjustment that the output when the synchronization is established is ±0. Therefore, by setting a relationship in phase between the rotor of the sync generator 17 and the rotor of the sync control transformer 18 so that when the phase difference increases from a state where the angle of deviation is zero, that is, a state in which the two shafts L and R are synchronous with each other with a predetermined phase difference (45 deg. in this embodiment), the deviation angle detected-value signal takes a positive polarity with respect to the speed command (same in polarity as the command) while, when the phase difference decreases from a state in which the angle of deviation is zero, the deviation angle detected-value signal takes a negative polarity (opposite polarity) with respect to the speed command, the deviation angle detected-value signal can be used as a speed correction signal for synchronization control, namely, to have the R-shaft follow up with the L-shaft.

The control units 11-2 and 11-3 control the primary current detected-value of the motor 4-1 provided from the current detector 18-1 as the primary current set-values of the motors 4-2 and 4-3, thereby controlling the torques generated by the motors 4-2 and 4-3 to be same as the torque generated by the motor 4-1. Similarly, the control units 11-5 and 11-6 control the primary current detected-value of the motor 4-4 provided from the current detector 18-4 as the primary current set-values of the motors 4-5 and 4-6, thereby controlling the torques generated by the motors 4-5 and 4-6 to be same as the torque generated by the motor 4-4.

Next, the construction of each control unit will be described in detail with reference to FIGS. 6 to 9.

Figure 6:
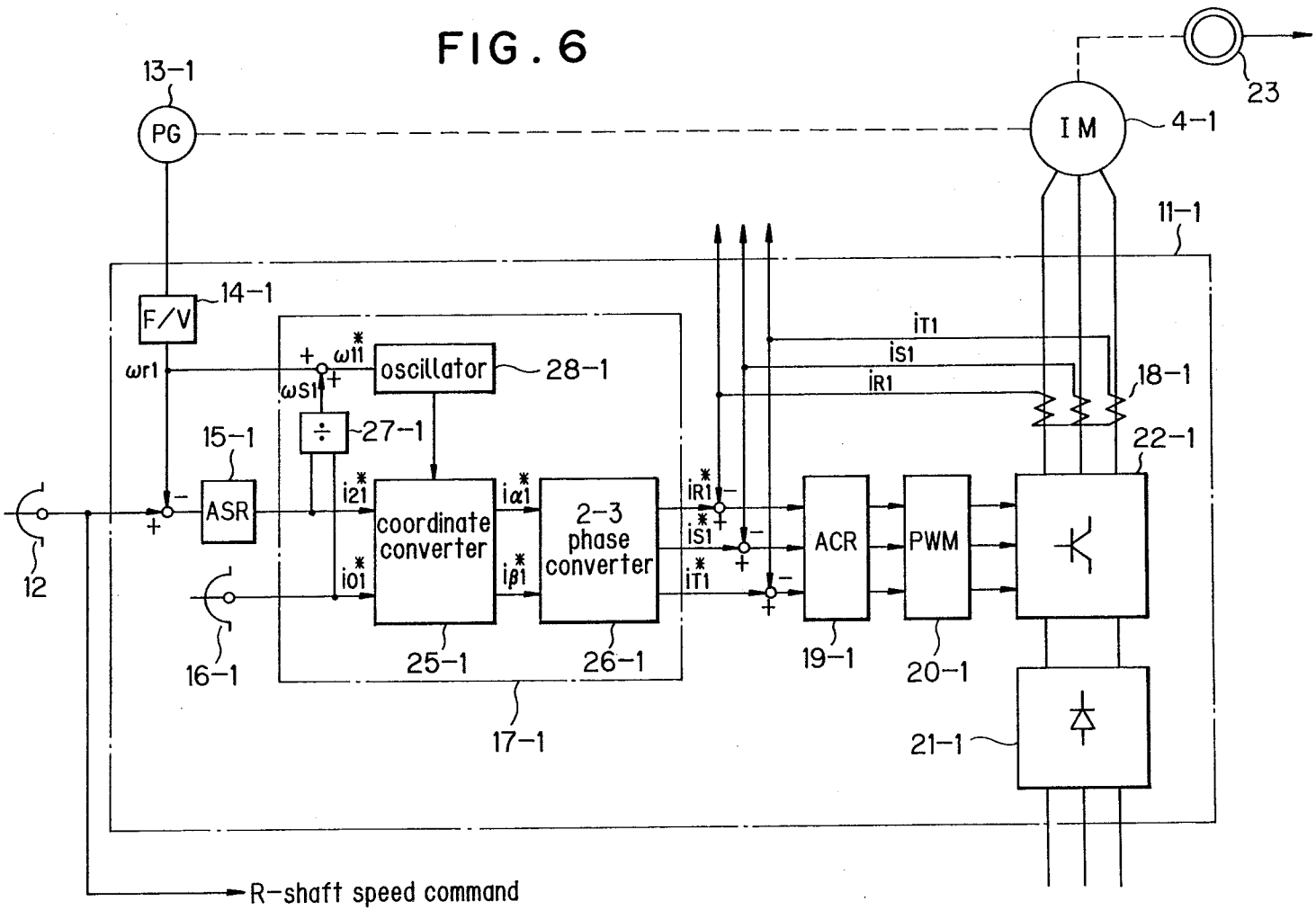
Figure 7:
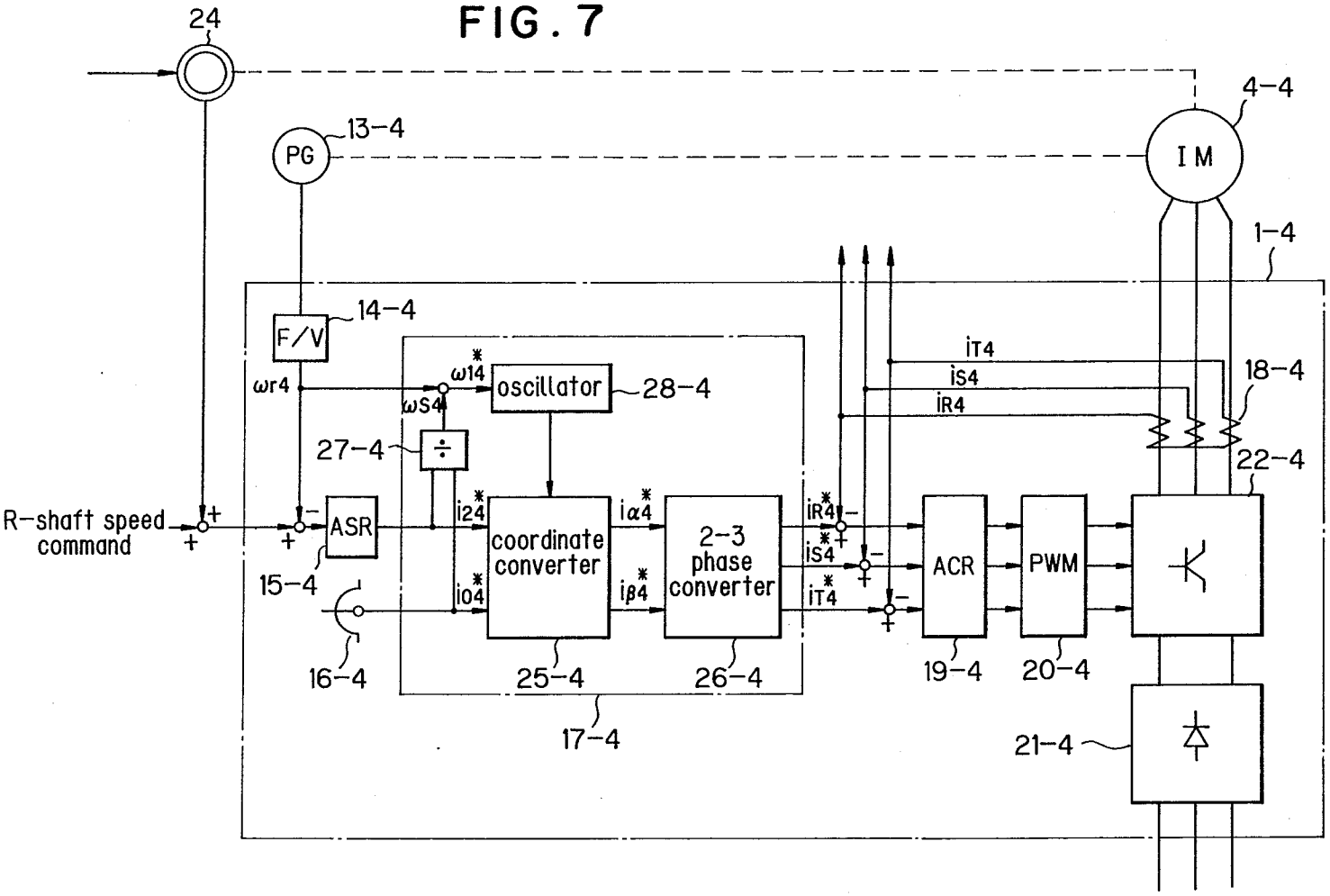

In FIGS. 6 and 7, $i_1$ and $i_2$ indicate magnetizing current and torque (secondary) current, respectively, being the magnetic flux coordinate values, $i_\alpha$ and $i_\beta$ indicate currents of different phases through equivalent two-phase windings being stator coordinate values, $i_R$, $i_S$ and $i_T$ indicate currents of different phases through the actual three-phase primary winding, $\omega_S$ indicates a slip frequency, $\omega_T$ indicates a rotation angle frequency and $\omega_1$ indicates a primary frequency. The second subscripts 1 and 4 of each symbol mean the motors 4-1 and 4-4. Also, the asterisks * and ** in Figures indicate set values, respectively. In the vector control of the squirrel-cage induction motor, a motor primary current magnetic flux is vector-decomposed into a magnetizing current component and a torque current component perpendicular to the magnetic flux and which is involved in the torque generation, and these parameters are controlled independently of each other. To this end, the output of the automatic speed regulator 15-1 and the output of the magnetic flux setter 16-1 in the control unit 11-1 shown in FIG. 6 are taken as a torque current set-value $i_{21}$* and a magnetizing current set value $i_{01}$*, respectively, converted by a coordinate converter 25-1 into equivalent two-phase current set-values $i_{\alpha 1}$* and $i_{\beta 1}$*, respectively, and further converted by the two/three phase converter 26-1 into three-phase primary current set-values $i_{R1}$*, $i_{S1}$* and $i_{T1}$*.

The coordinate converter 25-1 is a calculator which, according to the following equations, converts the values of magnetizing current $i_{01}$ and torque current $i_{21}$ being the coordinate values (magnetic flux coordinate values) viewed from the position of the magnetic flux into equivalent two-phase currents $i_{\alpha 1}$ and $i_{\beta 1}$ being the coordinate values (stator coordinate values) viewed from the position of the stator winding:

$$i_{\alpha 1}=i_{01}\cos\phi-i_{21}\sin\phi$$

$$i_{\beta 1}=i_{01}\sin\phi+i_{21}\cos\phi$$

where $\phi$: Magnetic flux phase

The two/three phase converter 26-1 is a calculator which, according to the following equations, converts the values $i_{\alpha 1}$ and $i_{\beta 1}$ of currents of different phases through the equivalent two-phase winding into such currents $i_{R1}$, $i_{S1}$ and $i_{T1}$ of different phases through the three-phase winding as give birth to composed current vectors equivalent to the currents $i_{\alpha 1}$ and $i_{\beta 1}$:

$$i_{R1} = 2/3\, i_{\alpha 1}$$

$$i_{S1} = -1/\sqrt{3}\, i_{\alpha 1} + 1/\sqrt{3}\, i_{\beta 1}$$

$$i_{T1} = -1/\sqrt{3}\, i_{\alpha 1} - 1/\sqrt{3}\, i_{\beta 1}$$

Such calculation circuits are described in "Illustrated Construction and Concept of the Motor Control" by Fumio Harajima, Kanji Suzuki and Takayoshi Nakano, Ohm-sha (first edition, Oct. 20, 1981), pp 185–198 "Vector Control".

In such parameter conversion, since the primary frequency (mains frequency) $\omega_{11}$ of the motor 4-1 is variable, a slip frequency $\omega_{s1}$ is obtained by a divider 27-1 from the torque current set-value $i_{21}$* and magnetizing current set-value $i_{01}$*, a sum of this slip frequency and a rotation angle frequency $\omega_{r1}$ obtained from the output of the pulse generator 13-1 is taken as primary frequency set-value $\omega_{11}$*, the output of an oscillator 28-1 which oscillates with $\omega_{11}$* is made to correspond to a magnetic flux phase $\phi$, and a coordinate conversion is done from the above-mentioned magnetic flux coordinate values $i_{01}$* and $i_{21}$* to stator coordinate values $i_{\alpha 1}$* and $i_{\beta 1}$* taking as a reference the magnetic flux phase $\phi$. The automatic current regulator 19-1 controls the output voltage of the inverter 22-1 and the frequency so as to coincide with the primary current set-values $i_{R1}$*, $i_{S1}$* and $1_{T1}$*, thereby rotating the motor 4-1 at the set speed. The block 17-1 enclosed with two dot line in FIG. 6 is the vector calculator.

The control unit 11-4 shown in FIG. 7 is composed of the similar elements to those illustrated and described in the foregoing, provided that the sum of the detected angle of deviation between the rotating cutter heads 2-1 and 2-2, obtained as output of the sync control transformer 24 and the R-shaft speed command from the speed setter 12 is compared with the speed detected-value from the pulse generator 13-4 and the deviation thus obtained is supplied to the automatic speed regulator 15-4.

Figure 8:
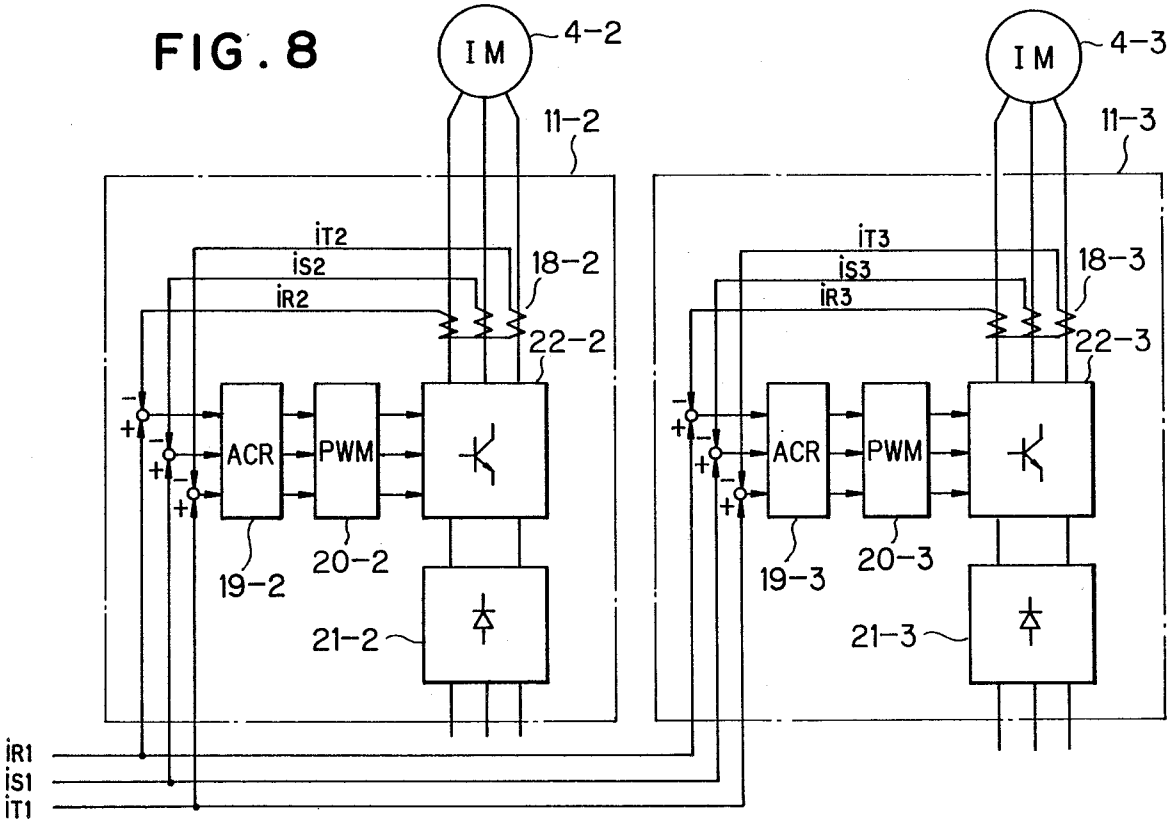

The control units 11-2 and 11-3 shown in FIG. 8 are supplied with primary current detected-values $i_{R1}$, $i_{S1}$ and $i_{T1}$ of the motor 4-1 as primary current set-values for the motors 4-2 and 4-3. This primary current set-value and deviations between the primary current detected-values $i_{R2}$, $i_{S2}$ and $i_{T2}$ and $i_{R3}$, $i_{S3}$ and $i_{T3}$ of the motors 4-2 and 4-3, obtained by the current detectors 18-2 and 18-3, are supplied to the automatic current regulators 19-2 and 19-3, the outputs of these automatic current regulators 19-2 and 19-3 are applied as pulse width control signals to the inverters 22-2 and 22-3, and DC outputs of the rectifiers 21-2 and 21-3 are converted into AC powers variable in frequency and voltage and supplied to the motors 4-2 and 4-3, thereby controlling the torques of the motors 4-2 and 4-3.

Figure 9:
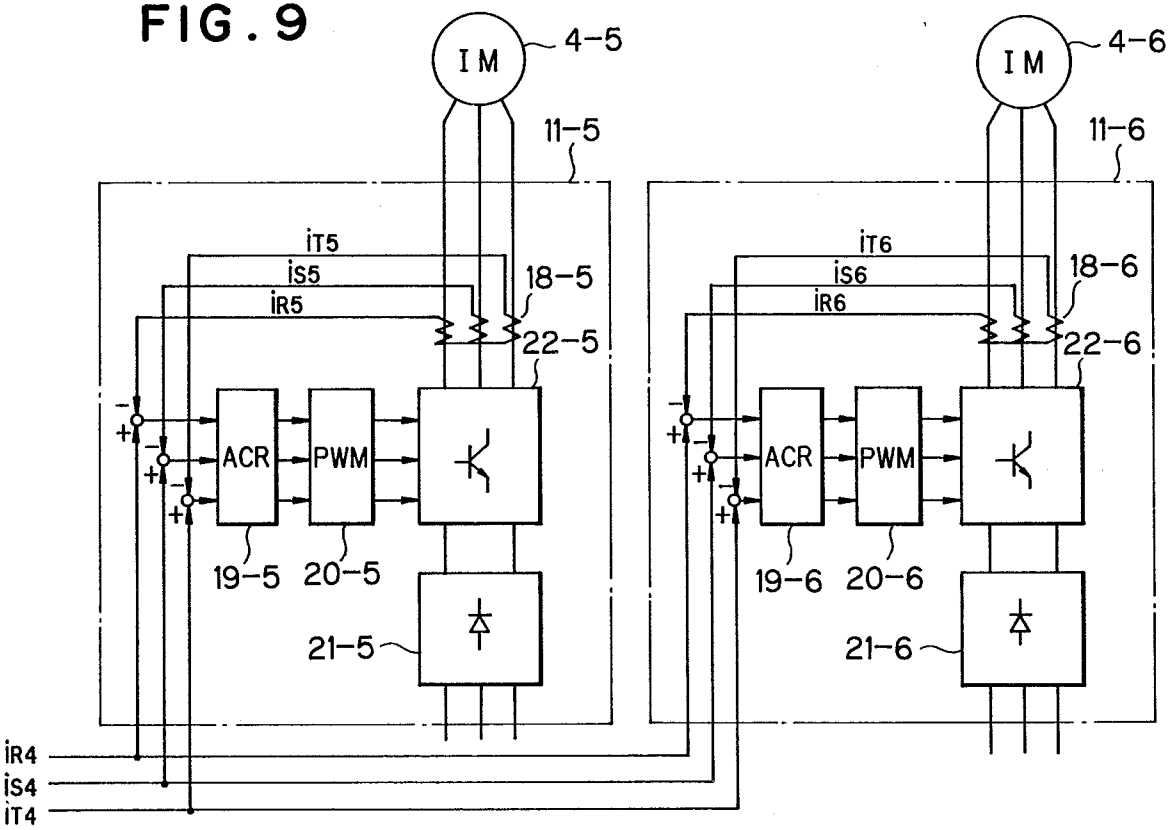

Also in the control units 11-5 and 11-6 shown in FIG. 9, the primary current detected-values $i_{R4}$, $i_{S4}$ and $i_{T4}$ of the motor 4-4 is taken as the primary current set-values for the motors 4-5 and 4-6, deviations between these primary current set-values and the primary current detected-values $i_{R5}$, $i_{S5}$ and $i_{T5}$ and $i_{R6}$, $I_{S6}$ and $I_{T6}$ of the motors 4-5 and 4-6, obtained by the current detectors 18-5 and 18-6, are supplied to the automatic current regulators 19-5 and 19-6, the outputs of the automatic current regulators 19-5 and 19-6 are modulated by the pulse width modulators (PWM) 20-5 and 20-6 into pulse-width modulated signals which are supplied to the inverters 22-5 and 22-6, and the DC outputs of the rectifiers 21-5 and 21-6 are converted into AC powers variable in frequency and voltage which are supplied to the motors 4-5 and 4-6, thereby controlling the torques of the motors 4-5 and 4-6.

The master motors of the motor groups and the subordinate motors in the groups are mechanically coupled with one another by means of pinions and gears and rotated at a same speed. So, by making the currents in different phases coincide with each other, the torques generated of the motors can be maintained to be always constant, whereby it is possible for the master motors of the motor groups and the subordinate motors in the groups to uniformly share the torque.

This embodiment is an example in which the present invention is applied to a two-cutter shield machine having two rotating cutter heads. The present invention is also applicable to a multi-cutter shield machine having more than two follow-up rotating cutter heads with a single reference rotating cutter head. Also, more than two motors may be used for driving each rotating cutter head.

Next, another embodiment according to the present invention will be described with reference to FIGS. 10 to 13. For the simplicity of illustration, the same elements as in FIGS. 1 to 9 are only shown with the same reference numerals or symbols in FIGS. 10 to 13 and will not be described.

Figure 10:
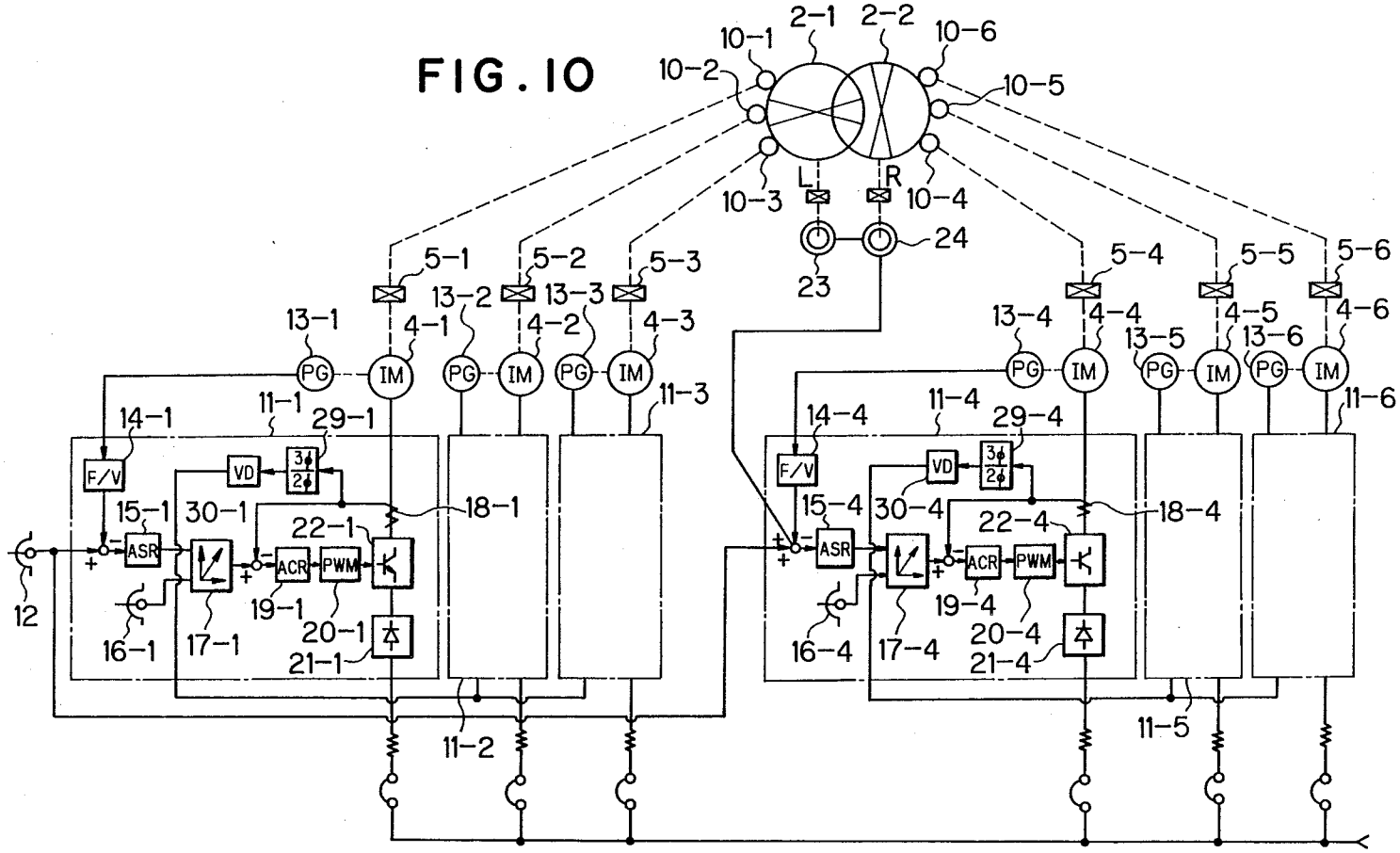

FIG. 10 is a system configuration diagram of the second embodiment. According to this embodiment, two rotating cutter heads are each driven by three motors (squirrel-cage induction motor) as in the preceding embodiment. Also in this embodiment, the cutter heads are synchronously rotated by controlling the speed of the master motors of the motor groups, which is similar to the first embodiment. For more accurate torque control of the subordinate motors in the motor groups, the subordinate motors are also subjected to vector control. To this end, the torque current component of the current detected-value of the master motor of each motor group is taken as torque command for the subordinate motors in the group, the supply voltage and frequency are so controlled that the torque current component of the current through the subordinate motors takes a value corresponding to the torque command, which is different from the first embodiment.

As seen from FIG. 10, the control units 11-1 and 11-4 for speed-control of the motors 4-1 and 4-2, respectively, are provided with three/two phase converters 29-1 and 29-4, respectively, and coordinate converters (VD) 30-1 and 30-4, respectively, for obtaining a torque current component from the current detected-values of the motors 4-1 and 4-2, obtained by the current detectors 18-1 and 18-4, respectively, and a signal corresponding to the torque current component thus obtained is applied to the control units 11-2 and 11-3, and 11-5 and 11-6 as torque command for the motors 4-2 and 4-3, and 4-5 and 4-6. The three/two phase converters 29-1 and 29-4 and coordinate converters (VD) 30-1 and 30-4 are calculators which work in opposite manners to the previously-mentioned two/three phase converters 25-1 and 25-4 and coordinate converters 26-1 and 26-4, respectively.

Figure 11:
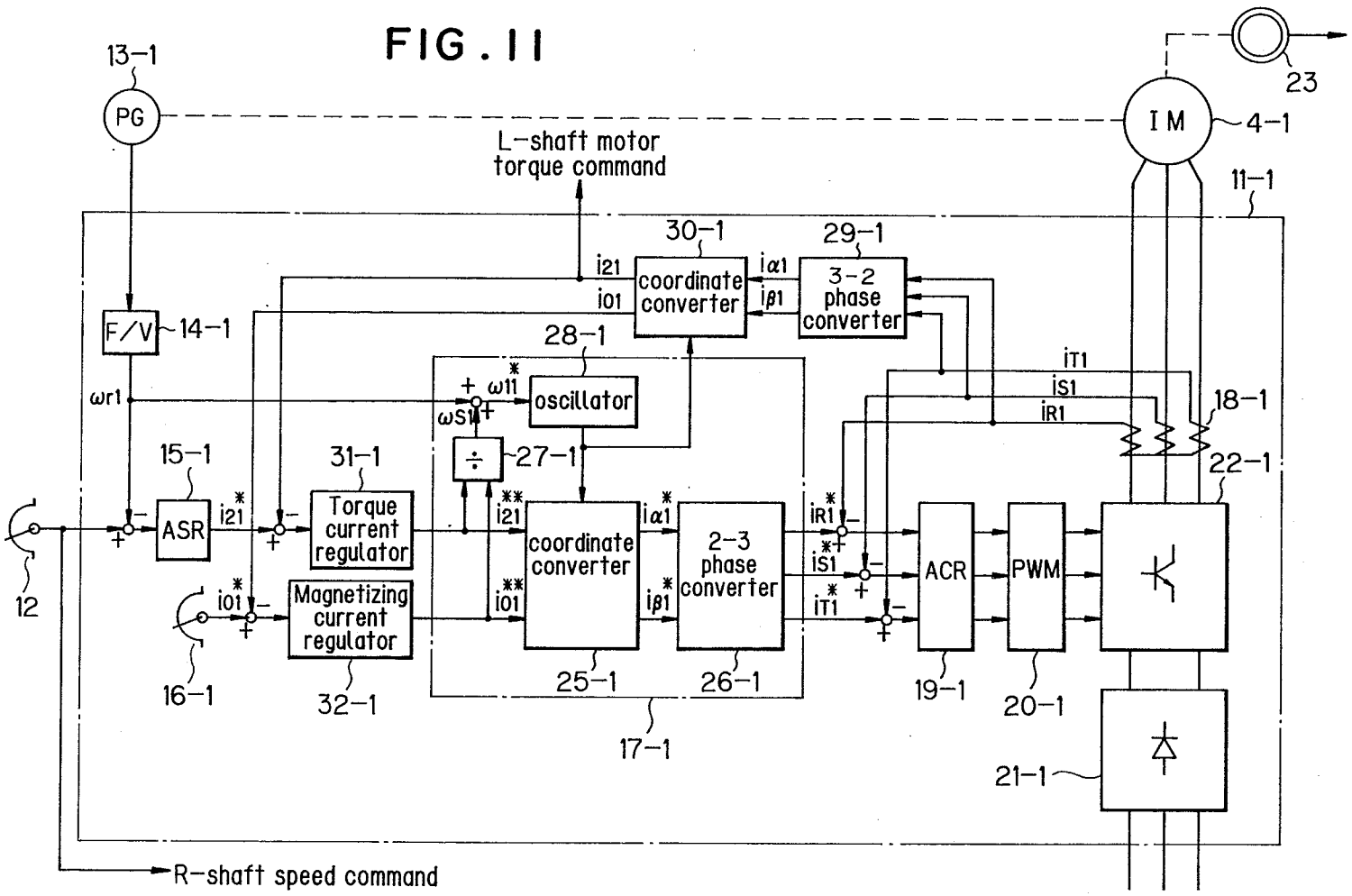
Figure 12:
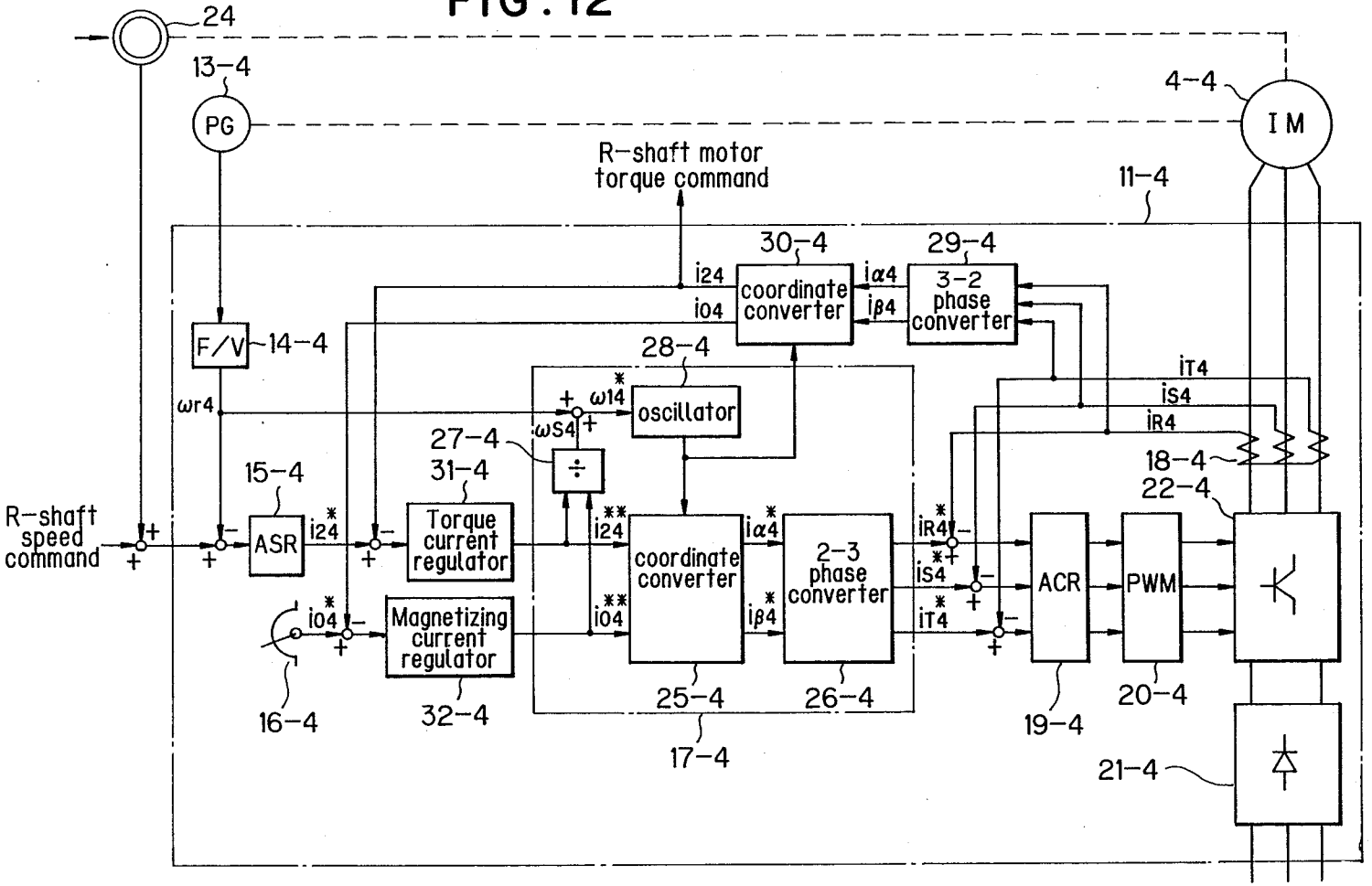

FIGS. 11 and 12 show in further detail the circuit configurations of the control units 11-1 and 11-4, respectively. The control unit 11-1 shown in FIG. 11 feeds back to the automatic current regulator 19-1 the primary current detected-values $i_{R1}$, $i_{S1}$ and $i_{T1}$ obtained by the current detector 18-1, converts these primary current detected-values $i_{R1}$, $i_{S1}$ and $i_{T1}$ into equivalent two-phase values $i_{\alpha 1}$ and $i_{\beta 1}$ by the three/two phase converter 29-1, and further vector-decomposes these signals into a magnetizing current component $i_{01}$ and torque current component $i_{21}$ by the coordinate converter 30-1 which converts a stator coordinate value into a magnetic flux coordinate value. DC value corresponding to the torque current component $i_{21}$ thus obtained is taken as a torque command for the motors 4-2 and 4-3.

In this embodiment, the torque current component (real value of torque current) $i_{21}$ and magnetizing current component (real value of magnetizing current) $i_{01}$ delivered from the coordinate converter 30-1 are taken as feedback values and compared with a torque current set-value $i_{21}$* given by the automatic speed regulator 15-1 and a magnetizing current set-value $i_{01}$* given by the magnetic flux setter 16-1, and the output $i_{21}$ of the torque current regulator 31-1 and output $i_{01}$ of the magnetizing current regulator 32-1 are applied to the coordinate converter 25-1 of the vector calculator 17-1 to make such a vector composition that the deviation between the values compared as above is zero, thereby improving the accuracy of the speed control.

The control unit 11-4 shown in FIG. 12 is similarly constructed and uses as torque command for the motors 4-5 and 4-6 the DC value corresponding to the torque current component $i_{24}$ delivered from the coordinate converter 30-4.

Figure 13:
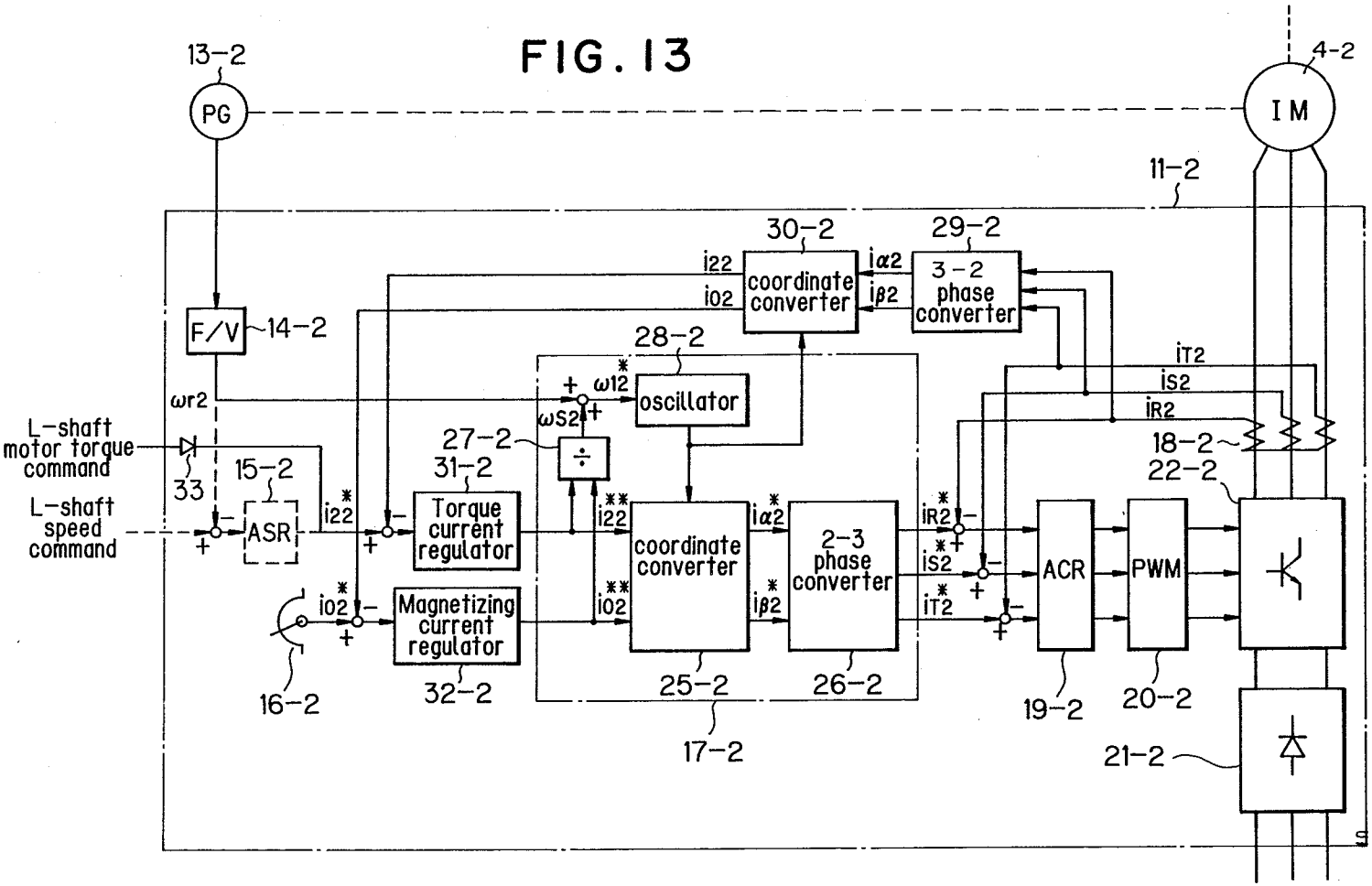

FIG. 13 shows the construction of the control units for the motors 4-2, 4-3, 4-5 and 4-6, respectively, taking the control unit 11-2 as typical one.

As having been described, according to this embodiment, the motors 4-2, 4-3, and 4-5 and 4-6 on the L- and R-shafts, respectively, are torque-controlled by a vector control. The configuration of the controls unit 11-2 shown in FIG. 13 is almost the same as that of the control units 11-1 and 11-4 shown in FIGS. 11 and 12. The vector calculator 17-2 obtains a slip frequency $\omega_{S2}$ from the output $i_{22}$* of the torque current regulator 31-2 and output i * of the magnetizing current regulator 32-2 by the divider 27-2, takes as primary frequency set-value $\omega_{12}$* the sum of the slip frequency $\omega_{s2}$ and the rotation angle frequency $\omega_{r2}$ obtained by converting the output of the pilot generator (PG) 13-2 by the frequency/voltage converter (F/V) 14-2, makes the output of the oscillator 28-2 which oscillates with $\omega_{12}$* correspond to the magnetic flux phase $\phi$, converts the magnetic flux coordinate values $i_{22}$* and $i_{02}$* into stator coordinate values $i_{\alpha 2}$ and $i_{\beta 2}$ by the coordinate converter 25-2 taking the magnetic flux phase $\phi$ as the reference, and further converts the stator coordinate values into the three-phase primary current set-values $i_{R2}$*, $i_{S2}$* and $i_{T2}$* by the three/two phase converter 26-2. The automatic current regulator 19-2 controls the output voltage and frequency of the inverter 22-2 by operating the pulse width modulator (PWM) 20-2 in such a manner that the primary current set-values $i_{R2}$, $i_{S2}$ and $i_{T2}$ of the motor 4-2, obtained by the current detector 18-2, are coincident with the primary current set-values $i_{R2}$*, $i_{S2}$* and $i_{T2}$*, respectively.

In addition, the primary current set values $i_{R2}$, $i_{S2}$ and $i_{T2}$ are converted into equivalent two-phase values $i_{\alpha 2}$ and $i_{\beta 2}$ by the three/two phase converter 29-2, these values thus obtained are vector-decomposed by the coordinate converter 30-2 taking the magnetic flux phase $\phi$ as the reference, and the torque current component $i_{22}$ and magnetizing current component $i_{02}$ thus obtained are fed back to the torque current regulator 31-2 and magnetizing current regulator 32-2, respectively.

In this control unit, torque control is done as follows. First, assume that the automatic speed regulator 15-2 indicated with a dash line is not provided, thus, there is not supplied any L-shaft speed command thereto and no signal from the F/V converter 14-2 is fed back thereto. The torque current regulator 31-2 works in such a manner, taking as torque current set-value $i_{22}$* an L-shaft motor torque command supplied from the coordinate converter 30-1 in the control unit 11-1, that the deviation between the torque current set-value and the feedback value of torque current component $i_{22}$ while the magnetizing current regulator 32-2 works in such as manner, taking as magnetizing current set-value $i_{02}$* the output from the magnetic flux setter 16-2, that the deviation between the magnetizing current set-value and the feedback value of the magnetizing current component $i_{02}$ becomes zero.

Thus, the motor 4-2 is subject to such a torque control that the magnetizing current component $i_{02}$ of the primary current is maintained constant and the torque current component $i_{22}$ corresponds to the torque current component $i_{21}$ of the motor 4-1 to which the torque current component $i_{22}$ is supplied as torque command. The torque generated by the motor 4-2 will thus be kept always the same as the torque generated by the motor 4-1.

Similarly, the torque generated by the motor 4-3 is so controlled as to be the same as the torque generated by the motor 4-1 by the L-shaft motor torque given by the coordinate converter 30-1 in the control unit 11-1. The torques generated by the motors 4-5 and 4-6 are so controlled as to be the same as the torque generated by the motor 4-4 by the R-shaft motor torque command given by the coordinate converter 30-4 in the control unit 11-4.

The torque control may be effected for individual motors, but the following may also be adopted. Namely, as shown with dash-line block in FIG. 13, there is additionally provided an automatic speed regulator 15-2 to which L-shaft speed command and a feedback signal from the frequency/voltage converter (F/V) 14-2 are supplied for speed-control of the motor 4-2 normally taking as torque current set value $i_{22}$* the output of the automatic speed regulator 15-2 when supplied with the L-shaft speed command common to the motor 4-1, and when the torque current of the motor 4-1 becomes abnormally large due to the increase of the load torque, the torque command from the coordinate converter 30-1 is given a priority through a diode 33 and the torque generated by the motor 4-2 is increased correspondingly.

Figure 14:
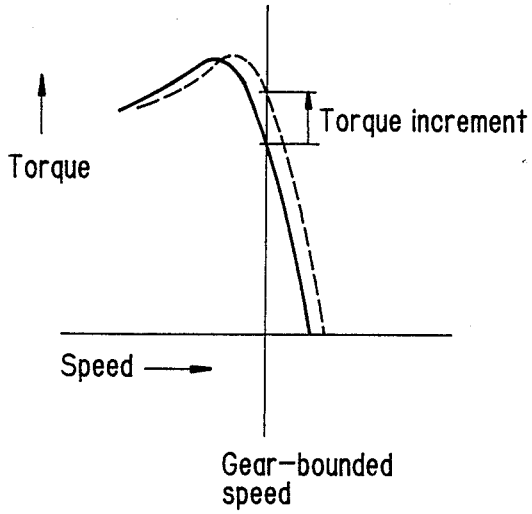

FIG. 14 is an explanatory drawing of the torque control in case the primary voltage and frequency of the motor are variable. As the load torque to a master motor of a motor group increases, the control system increases the torque current of that motor in order to maintain the set speed. At this time, the speed vs. torque curve of the subordinate motors in the motor group rapidly goes from the solid-line portion to the dash-line portion correspondingly to the increase of the torque command as will be seen in FIG. 14, as in the increase of the set speed, but as the motor rotation speed is gear-bounded, the torque generated at this gear-bounded speed increases for the torque increment shown in FIG. 14 so that the torque sharing with a master motor of the motor group is balanced.

According to this embodiment, the subordinate motors of the motor groups are torque-controlled by the vector control excellent in dynamic performance. Hence, a torque control can be done in quick response to a variation in torque of a master motor of each motor group.

As having been described in the foregoing, the present invention provides a multi-cutter shield machine having a plurality of rotating cutter heads disposed in generally same planes, wherein the cutter heads are rotated synchronously with each other by the speed control of a master motor of a motor group which drives each rotating cutter head, while the subordinate motors in each motor group are so torque-controlled that the master motor of each motor group and the subordinate motors in the same group share the torque uniformly. Therefore, the plural cutter heads can be rotated synchronously with each other with such an allowable angle of deviation as will not cause any interference between them, without being affected by the imbalance in excavating and rotating resistances between the rotating cutter heads and also with the synchronization between the cutter heads not being disturbed by any imbalance in torque sharing between the plural motors driving the cutter heads.

What is claimed is:

1. A control system for controlling synchronous rotation of a plurality of rotating cutter heads in a multi-cutter shield machine, said rotating cutter heads are generally disposed in the same plane and the distance between the centers of the adjoining rotating cutter heads is larger than the radius but smaller than the diameter of the rotating cutter heads, comprising:

a plurality of electric drive systems to respectively and independently drive said plurality of rotating cutter heads, each drive system includes a plurality of motors which are coupled to the respective cutter head by means of a pinion and reducing gears;

a control means for synchronously rotating the adjoining first and second ones of said rotating cutter heads with an allowable deviation angle which will not cause interference between the first and the second cutter head;

said control means comprising:

a means for detecting an angle of deviation, or the difference in rotation angle between the first and second rotating cutter heads, and for delivering a deviation angle detected value signal corresponding to the detected angle of deviation;

a first means for detecting the rotation speed of a master motor in the plurality of motors comprising a first one of said electric drive systems which drives said first rotating cutter head, wherein said first means delivers a rotation speed signal corresponding to the detected rotation speed of the master motor of the first drive system;

a second means for detecting the rotation speed of a master motor in the plurality of motors comprising a second one of said electric drive systems which drives said second rotating cutter head, wherein said second means delivers a rotation speed signal corresponding to the detected rotation speed of the master motor of the second drive system;

a speed setting means for setting a speed command to the master motor of each of said first and second drive systems;

a first speed control means for comparing the rotation speed signal delivered from said first means with the speed command given by said speed setting means, and for adjusting the power supplied to the master motor of the first drive system so that the deviation resulting from the comparison becomes zero;

a second speed control means for comparing the rotation speed signal delivered from said second means with the sum of said speed command and said deviation angle detected value signal, and for adjusting the power supplied to the master motor of the second drive system so that the deviation resulted from the comparison becomes zero;

a first torque setting means for detecting the current through the master motor of the first drive system, and for setting a torque command based on a detected current value of the master motor and for providing said torque command to the slave motors in the first drive system;

a second torque setting means for detecting the current through the master motor of the second drive system, and for setting a torque command based on a detected current value of the master motor and for providing said torque command to the slave motors in the second drive system; and torque controlling means for adjusting power supplied to the slave motors in the first and second drive system so that the torques generated by the slave motors in the respective drive system are the same as the torques generated by the master motor of the respective drive system.

2. The control system according to claim 1, wherein:

said motors driving said first and second rotating cutter heads are squirrel cage induction motors;

said first and second torque setting means are so constructed as to detect primary currents in different phases of the master motors of the first and second drive systems and deliver the detected current values as said torque commands;

and wherein said torque controlling means comprises:

a current detecting means for detecting primary currents in different phases of the slave motors in said first and second drive systems, and for delivering current detected value signals corresponding to the detected current values;

a variable frequency and variable voltage power converting means for adjusting the power supplied to the slave motors in said first and second drive systems; and a means for comparing the torque commands from said first and second torque setting means with said current detected value signals corresponding to the torque commands, and for delivering a control signal to said power converting means so that the deviation resulting from the comparison becomes zero.

3. The control system according to claim 1, wherein:

said motors driving said first and second rotating cutter heads are squirrel cage induction motors;

said first and second torque setting means are so constructed as to detect primary currents in different phases of the master motors of the first and second drive systems, and deliver torque current components of the detected current values as torque commands;

and wherein said torque controlling means comprises:

a current detecting means for detecting primary currents in different phases of the slave motors in said first and second drive systems, and for delivering current detected value signals corresponding to the detected current values;

a variable frequency and variable voltage power converting means for adjusting the power supplied to the slave motors in said first and second drive systems;

a means for generating a constant magnetizing current component of the motor primary current based on the torque command values from said first and second torque setting means, and for calculating the primary current set values in different phases for making the torque current components having values corresponding to said torque command values; and a means for comparing said primary current set values in different phases with the values of the current detected value signal corresponding to the primary current set values, and for delivering a control signal to said power converting means so that the deviation resulting from the comparison becomes zero.

* * * * *